US009336708B2

(12) United States Patent
Kim et al.

(10) Patent No.: US 9,336,708 B2
(45) Date of Patent: May 10, 2016

(54) ORGANIC LIGHT EMITTING DIODE DISPLAY AND REPAIRING METHOD THEREOF

(71) Applicant: SAMSUNG DISPLAY CO., LTD., Yongin, Gyeonggi-Do (KR)

(72) Inventors: Tae Gon Kim, Cheonan-si (KR); Jae-Sic Lee, Cheonan-si (KR); Jin-Yup Kim, Cheonan-si (KR); Ji Yong Park, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/312,898

(22) Filed: Jun. 24, 2014

(65) Prior Publication Data

US 2015/0102985 A1 Apr. 16, 2015

(30) Foreign Application Priority Data

Oct. 11, 2013 (KR) ..... 10-2013-0121464

(51) Int. Cl.
*G09G 3/32* (2006.01)

(52) U.S. Cl.
CPC ..... *G09G 3/3216* (2013.01); *G09G 2300/0408* (2013.01); *G09G 2300/0413* (2013.01); *G09G 2330/08* (2013.01)

(58) Field of Classification Search
CPC ..... G09G 3/3216; G09G 2300/0413; G09G 2330/08; G09G 2300/0408; G09G 3/3225; G09G 3/32
USPC ..... 345/76
See application file for complete search history.

(56) References Cited

U.S. PATENT DOCUMENTS

2002/0136207 A1* 9/2002 Matsumoto ..... H04L 49/254 370/352
2009/0294771 A1* 12/2009 Kim ..... G02F 1/136204 257/59
2010/0157190 A1* 6/2010 Lee ..... G02F 1/136259 349/54
2012/0013598 A1* 1/2012 Choe ..... G09G 3/3614 345/214

FOREIGN PATENT DOCUMENTS

JP 2007-316511 A 12/2007
KR 10-0483386 B1 4/2005
KR 10-2008-0022357 A 3/2008
KR 10-2008-0024009 A 3/2008
KR 10-2008-0044073 A 5/2008
KR 10-2010-0065745 A 6/2010

* cited by examiner

*Primary Examiner* — Joseph Haley
*Assistant Examiner* — Chineyere Wills-Burns
(74) *Attorney, Agent, or Firm* — Lee & Morse, P.C.

(57) ABSTRACT

An organic light emitting device includes a substrate including a display unit configured to display an image and a peripheral portion surrounding the display unit, a plurality of scan lines on the substrate and extending in a first direction, a plurality of data lines on the substrate and intersecting the scan lines in a second direction, a plurality of pixels at the display unit and connected to the scan lines and the data lines, a repair ring surrounding the display unit, a plurality of driving pads on the peripheral portion and connected to ends of the plurality of data lines, a pair of dummy driving pads on the peripheral portion and connected to ends of the repair ring, and a driving circuit configured to transmit a data signal to the plurality of driving pads and to the pair of dummy driving pads.

13 Claims, 5 Drawing Sheets

ORGANIC LIGHT EMITTING DIODE DISPLAY AND REPAIRING METHOD THEREOF

CROSS-REFERENCE TO RELATED APPLICATION

Korean Patent Application No. 10-2013-0121464, filed on Oct. 11, 2013, in the Korean Intellectual Property Office, and entitled: "Organic Light Emitting Diode Display And Repairing Method Thereof," is incorporated by reference herein in its entirety.

BACKGROUND

1. Field

The present disclosure relates to an organic light emitting device and a repairing method thereof.

2. Description of the Related Art

An organic light emitting diode display includes two electrodes and an organic light emitting layer positioned therebetween. Electrons injected from a cathode that is an electrode and holes injected from an anode that is another electrode are combined with each other in the organic light emitting layer to form excitons. Light is emitted while the excitons discharge energy.

The organic light emitting diode display includes a plurality of pixels including an organic light emitting diode formed of the cathode, the anode, and the organic light emitting layer. A plurality of thin film transistors and capacitors for driving the organic light emitting diode are formed in each pixel.

SUMMARY

The present disclosure provides an organic light emitting device in which a faulty pixel can be repaired without a voltage drop, and a repairing method thereof.

An organic light emitting device according to an exemplary embodiment includes a substrate including a display unit configured to display an image and a peripheral portion surrounding the display unit, a plurality of scan lines on the substrate and extending in a first direction, a plurality of data lines on the substrate, the plurality of date lines intersecting the scan lines and extending in a second direction, a plurality of pixels at the display unit and connected to the scan lines and the data lines, a repair ring on the peripheral portion of the substrate, the repair ring surrounding the display unit, a plurality of driving pads on the peripheral portion of the substrate, the plurality of driving pads being connected to ends of the plurality of data lines, a pair of dummy driving pads on the peripheral portion of the substrate, the pair of dummy pads being connected to ends of the repair ring, and a driving circuit configured to transmit a data signal to the plurality of driving pads and to the pair of dummy driving pads.

A plurality of driving circuit output lines connecting the driving circuit and the plurality of driving pads and the pair of dummy driving pads, and an amplifier positioned at the driving circuit output line, may be further included.

The driving circuit may transmit the same data signal as the data signal transmitted to the driving pad connected to the faulty data line among the plurality of data lines to the dummy driving pad connected to the repair ring.

A dummy connection wire crossing the driving circuit output line may be further included.

The repair ring may be divided into a left repair ring and a right repair ring.

Also, a repairing method of an organic light emitting device according to an exemplary embodiment of the present invention includes: detecting a failure of a data line of an organic light emitting device including a substrate including a display unit displaying an image and a peripheral portion enclosing the display unit, a plurality of scan lines formed on the substrate and extending in a first direction, a plurality of data lines intersecting the scan lines and extending in a second direction, a plurality of pixels formed at the display unit and connected to the scan lines and the data lines, a repair ring enclosing the display unit and formed at the peripheral portion, a plurality of driving pads formed at the peripheral portion and connected to ends of the plurality of data lines, a pair of dummy driving pads formed at the peripheral portion and connected to ends of the repair ring, and a driving circuit transmitting a data signal to the plurality of driving pads and the pair of dummy driving pads; and short-circuiting the faulty data line detected in the step of detecting the failure of the data lines and the repair ring.

The repairing method may further include transmitting the same data signal as the data signal transmitted to the driving pad connected to the faulty data line to the dummy driving pad connected to the repair ring by using the driving circuit.

A plurality of driving circuit output lines connecting the driving circuit and the plurality of driving pads, and a dummy connection wire intersecting the driving circuit output line, may be further included.

The repairing method may further include short-circuiting the driving circuit output line connected to the driving pad connected to the faulty data line and the dummy connection wire to each other, and transmitting the same data signal as the data signal transmitted to the driving pad connected to the faulty data line to the dummy driving pad connected to the repair ring by using the shorted dummy connection wire.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
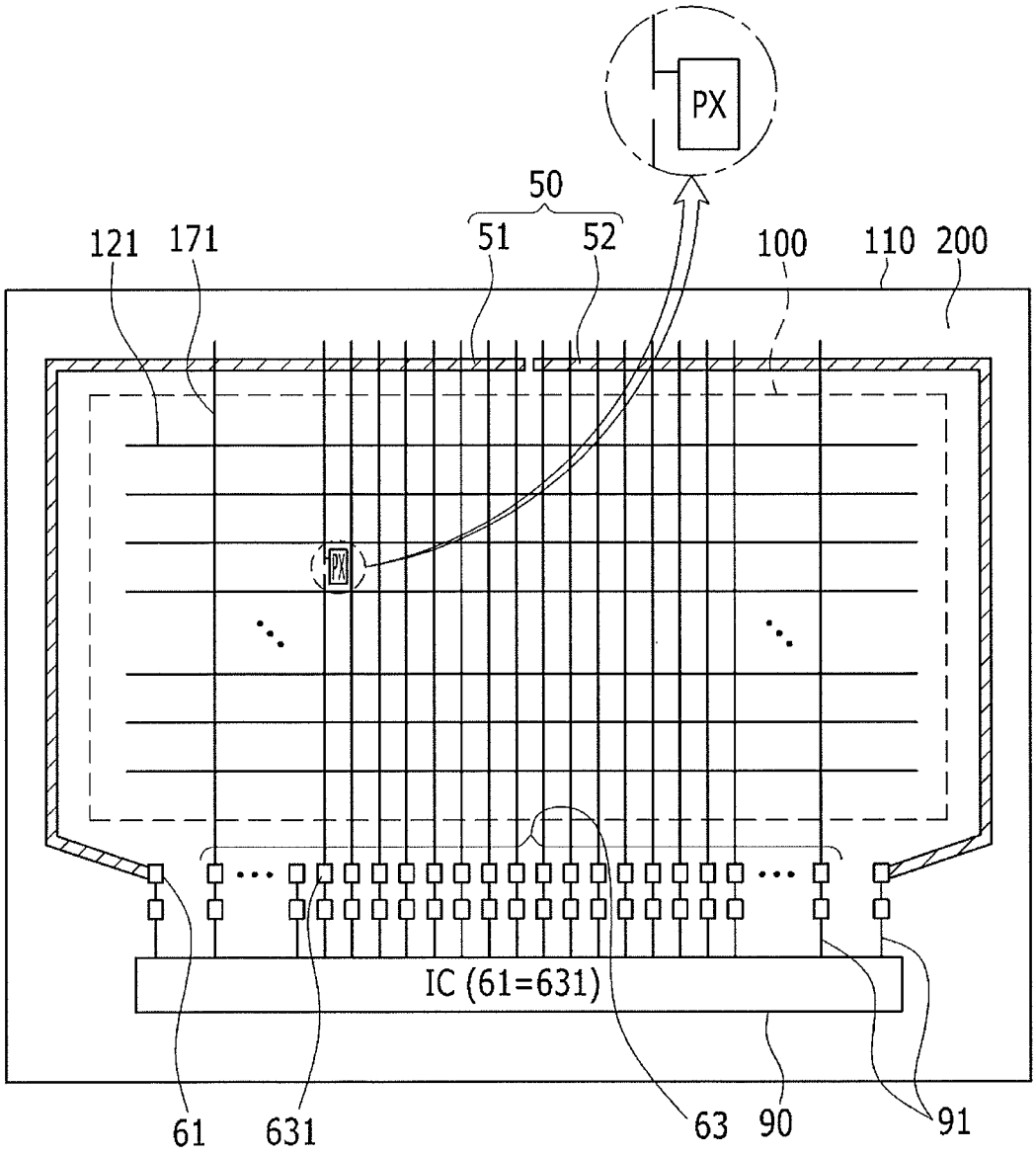
FIG. 1 illustrates a circuit diagram of an organic light emitting device according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Throughout the specification, for the purpose of clarity, parts that are not relevant to the detailed description of the present disclosure will be omitted, and the same reference numerals will be used for like or equivalent constituent elements.

In the drawings, size and thickness of each element are approximately shown for better understanding and ease of description. Therefore, the present disclosure is not limited to the drawings. Further, in the drawings, the thickness of layers, films, panels, regions, etc., may be exaggerated for clarity. Also, it will be understood that when an element such as a layer, film, region, or substrate is referred to as being "on" another element, it can be directly on the other element or intervening elements may also be present.

In addition, unless explicitly described to the contrary, the word "comprise" and variations such as "comprises" or "comprising" will be understood to imply the inclusion of stated elements but not the exclusion of any other elements. Further, in the specification, an upper part of a target portion indicates an upper part or a lower part of the target portion, and it does not mean that the target portion is always positioned at the upper side based on a gravity direction.

An organic light emitting device according to an exemplary embodiment will be described with reference to FIG. 1 and FIG. 2.

Figure 2:
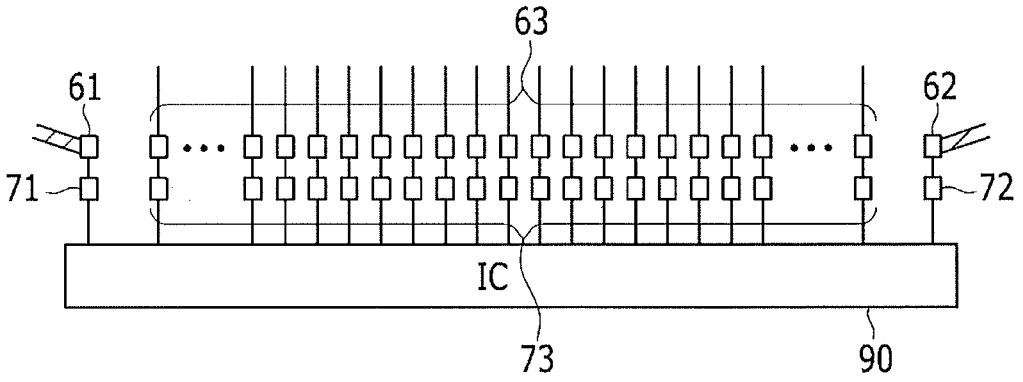
FIG. 2 illustrates an enlarged view of a peripheral portion of an organic light emitting device according to an exemplary embodiment.

FIG. 1 illustrates a circuit diagram of an organic light emitting device according to an exemplary embodiment, and FIG. 2 illustrates an enlarged view of a peripheral portion of an organic light emitting device according to an exemplary embodiment.

As shown in FIG. 1 and FIG. 2, an organic light emitting device according to an exemplary embodiment may include a substrate 110, a plurality of scan lines 121 formed on the substrate 110, a plurality of data lines 171, a plurality of pixels PX, a repair ring 50, a plurality of driving pads 63, a pair of dummy driving pads 61 and 62, and a driving circuit (IC) 90.

The substrate 110 may include a display unit 100, e.g., a display portion 100, displaying an image and a peripheral portion 200 enclosing the display unit 100. The scan lines 121, the data lines 171, and the pixels PX are formed in the display unit 100, and ends of the scan lines 121, ends of the data lines 171, the repair ring 50, the driving pads 63, the dummy driving pads 61 and 62, and the driving circuit 90 are formed in the peripheral portion 200.

The scan lines 121 transmit a scan signal and extend in a horizontal direction as a first direction, and the data lines 171 transmit a data signal and extend in a vertical direction as a second direction thereby intersecting the scan lines 121.

Each pixel PX includes a pixel circuit portion connected to the scan line 121 and the data line 171, and an organic light emitting diode (OLED) connected to the pixel circuit portion. The pixel circuit portion includes a plurality of thin film transistors and capacitors to drive the organic light emitting diode (OLED), and the organic light emitting diode (OLED) includes a cathode, an anode, and an organic emission layer.

The repair ring 50 encloses the display unit 100 and is formed at the peripheral portion 200. The repair ring 50 intersects the ends of the data lines 171, and is divided into a left repair ring 51 and a right repair ring 52 to prevent a signal delay. For example, the repair ring 50 intersects first ends, e.g., ends of data lines 171 facing away from the driving circuit 90, of all the data lines 171.

The driving pads 63 are connected to the ends of the plurality of data lines 171, e.g., each driving pad 63 is connected to an end of a corresponding data line 171. For example, the driving pads 63 may be connected to second ends of the data lines 171, i.e., ends of the data lines facing the driving circuit 90.

The dummy driving pads 61 and 62 are respectively connected to ends of the left repair ring 51 and the end of the right repair ring 52. For example, as illustrated in FIG. 1, the dummy driving pad 61 may be connected to an edge of the left repair ring 51, and the dummy driving pad 62 may be connected to an edge of the right repair ring 52. For example, the dummy driving pads 61 and 62 may be in a region between the display unit 100 and the driving circuit 90, e.g., the dummy driving pads 61 and 62 may be aligned with the driving pads 63 along the horizontal direction.

The driving circuit 90 transmits the data signal to the plurality of driving pads 63 and the dummy driving pads 61 and 62, and may include a timing controller. A plurality of driving circuit output lines 91 are formed between the driving circuit 90 and the plurality of driving pads 63, and connect the driving circuit 90 and the plurality of driving pads 63. A driving circuit output line 91 is also formed between the driving circuit 90 and each of the pair of dummy driving pads 61 and 62 and connects the driving circuit 90 and the pair of dummy driving pads 61 and 62. Amplifiers 71, 72, and 73 to amplify a signal output from the driving circuit 90 may be formed in the driving circuit output lines 91.

According to embodiments, the driving circuit 90 transmits a same data signal to the plurality of driving pads 63 and the dummy driving pads 61 and 62. Therefore, if one of the data lines 171 is faulty, a same data signal transmitted to a driving pad 63 of the faulty data line is also transmitted to the dummy driving pads 61 and 62, which are connected to the repair ring 50. As such, the data signal from the driving circuit 90 may be transferred through the dummy driving pads 61 and 62 and through the repair ring 50 to the faulty data line, such that the faulty data line may be driven without a voltage drop. However, for the data signal to be transmitted through the repair ring 50 to the faulty data line, a repairing process via a short-circuit of the faulty data line and the repair ring 50 is required, as will be described in more detail below with reference to FIG. 3.

Figure 3:
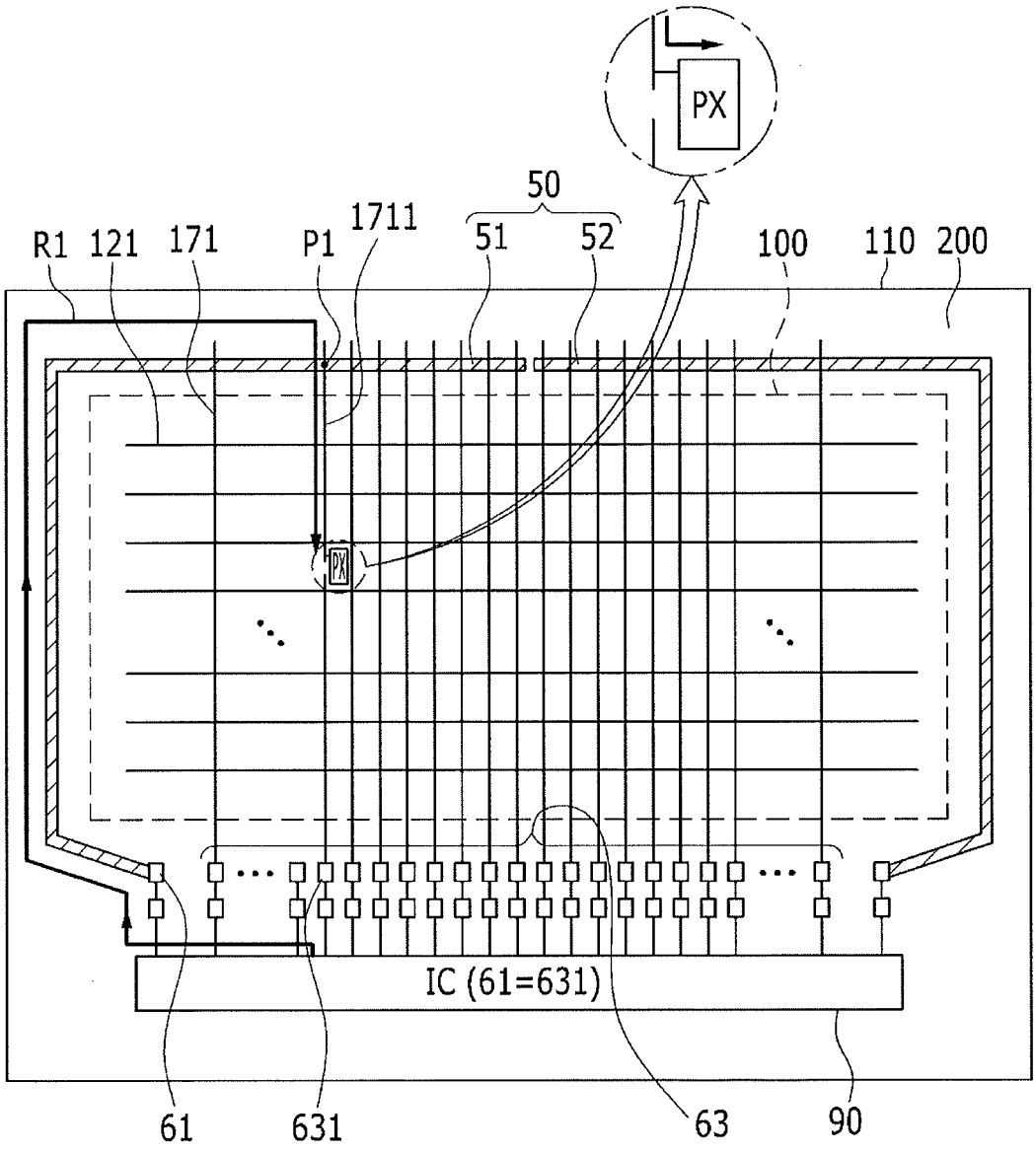
FIG. 3 illustrates a repairing method of an organic light emitting device according to another exemplary embodiment.

A repairing method of the organic light emitting device according to an exemplary embodiment will be described with reference to FIG. 3. FIG. 3 illustrates a view showing a repairing method of an organic light emitting device according to an exemplary embodiment.

Referring to FIG. 3, in the repairing method of the organic light emitting device according to an exemplary embodiment, firstly, a failure of a data line 1711 of the organic light emitting device is detected. At this time, detection of the failure of the data line 1711 may be performed by any suitable method, e.g., by a visual inspection.

Next, the repair ring 50, which crosses the detected faulty data line 1711 at point P1, is short-circuited at the crossing point P1. The faulty data line 1711 and the repair ring 50 may be short-circuited at point P1 by using a laser.

Next, by using the driving circuit 90, the same data signal as that transmitted to a driving pad 631 connected to the faulty data line 1711 is also transmitted to the dummy driving pads 61 and 62 connected to the repair ring 50. At this time, to elongate the transmission path of the data signal, the repairing process may be performed by using the left repair ring 51 connected to the left dummy driving pad 61 for a faulty data line positioned at the left of the display unit 100 and by using the right repair ring 52 connected to the right dummy driving pad 62 for a faulty data line positioned at the right of the display unit 100.

Accordingly, by using the driving circuit 90, a same data signal intended for the faulty data line 1711 via the driving pad 631 is transmitted to the faulty data line 1711 via one of the dummy driving pads 61 and 62 through the repair ring 50. That is, as shown in FIG. 3, the data signal intended for a pixel connected to the faulty data line 1711 is transmitted to the pixel through the repair ring 50, i.e., through a first repair path R1, without the voltage drop.

In the exemplary embodiment, the same data signal as that transmitted to the driving pad 631 connected to the faulty data line 1711 is transmitted to the dummy driving pad 61 by only using the driving circuit 90. However, according to another exemplary embodiment, a direct connection between the driving pad 631, which is connected to the faulty data line 1711, and the dummy driving pad 61 by using a separate dummy connection wire is possible.

Figure 4:
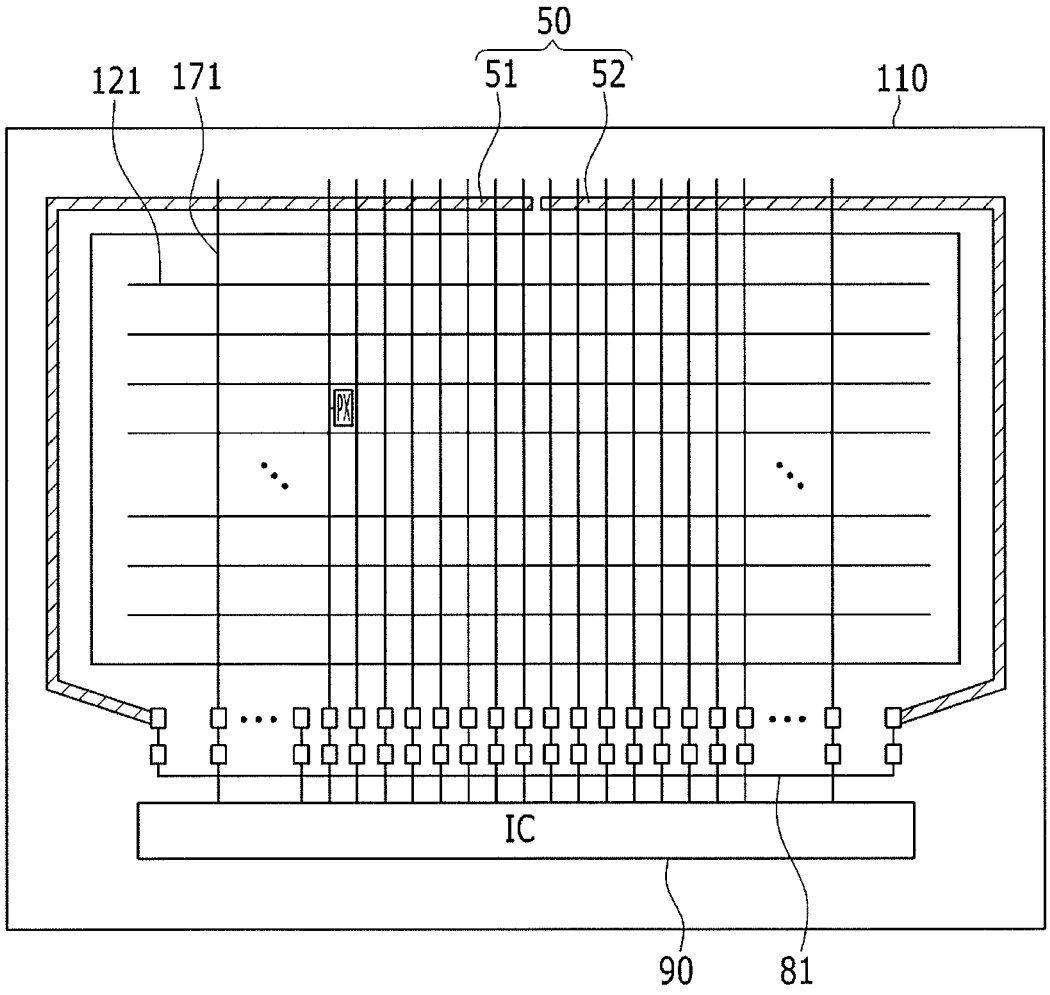
FIG. 4 illustrates a circuit diagram of an organic light emitting device according to an exemplary embodiment.

FIG. 4 illustrates a circuit diagram of an organic light emitting device according to another exemplary embodiment.

The exemplary embodiment shown in FIG. 4 is substantially the same as the exemplary embodiment shown in FIG. 1 and FIG. 2 except for a separate dummy connection wire such that the repeated description is omitted.

As shown in FIG. 4, an organic light emitting device according to the current exemplary embodiment includes a dummy connection wire 81 crossing the driving circuit output lines 91. The dummy connection wire 81 may be formed on a different layer, e.g., a different height level, from that of the driving circuit output lines 91 to be crossed, thereby short-circuiting the dummy driving pads 61 and 62 to be connected to each other and the driving pad 631 connected to the faulty pixel by using the laser. Also, the dummy connection wire 81 includes a switching structure, such that the dummy driving pads 61 and 62 and the driving pad 631 may be connected.

Figure 5:
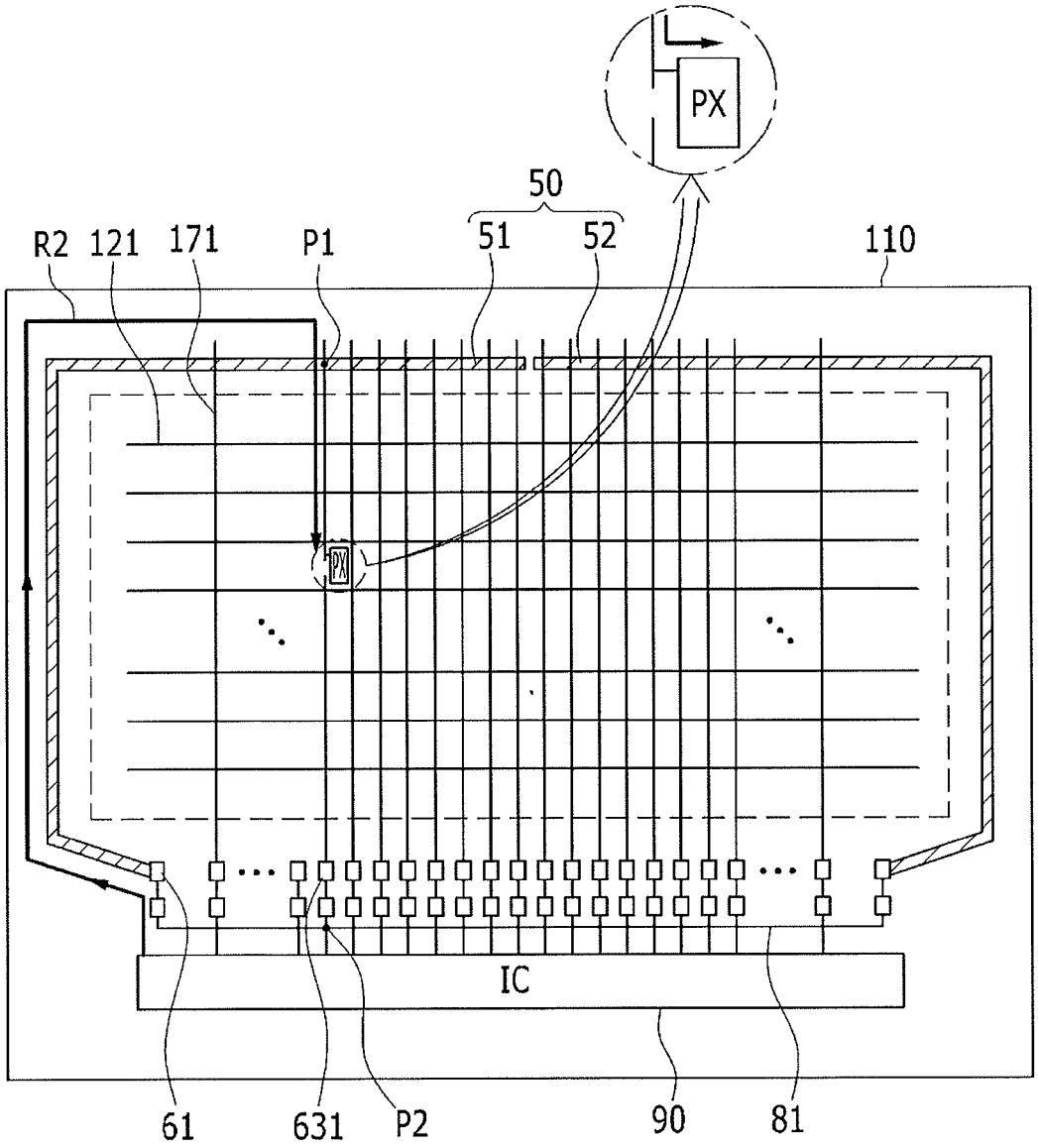
FIG. 5 illustrates a repairing method of an organic light emitting device according to another exemplary embodiment.

The repairing method of the organic light emitting device of FIG. 4 will be described with reference to FIG. 5. FIG. 5 illustrates a repairing method of an organic light emitting device according to another exemplary embodiment.

As shown in FIG. 5, in the repairing method of the organic light emitting device according to the current exemplary embodiment, firstly, the failure of a data line 1711 of the organic light emitting device is detected. Next, the repair ring 50 crossing the detected faulty data line 1711 is short-circuited at the crossing point P1 of the faulty data line 1711 and the repair ring 50. Also, the driving circuit output line 91 connected to the driving pad 631, which is connected to the faulty data line 1711, and the dummy connection wire 81 are short-circuited to each other at a crossing point P2, i.e., an intersection point between the driving circuit output line 91 and the dummy connection wire 81. At this time, the driving circuit output line 91 and the dummy connection wire 81 may be short-circuited by using the laser.

Next, by using the driving circuit 90 and the dummy connection wire 81, the same data signal as that transmitted to the driving pad 631 connected to the faulty data line 1711 is transmitted to the dummy driving pads 61 and 62 connected to the repair ring 50, and is transmitted to the faulty data line 1711 from the dummy driving pad 61 and 62 through the repair ring 50. That is, as shown in FIG. 5, the data signal is transmitted to the pixel through a second repair path R2 without the voltage drop.

By way of summary and review, a pixel failure due to a characteristic deviation of elements or a disconnection or a short of wires formed in each pixel of a conventional organic light emitting device may be generated. In this case, a conventional repair ring may be formed at a circumference of the organic light emitting device, and a laser is irradiated to an overlapping portion of an extension line of the data line connected to the faulty pixel and the repair ring to generate a short therebetween, thereby repairing the faulty pixel. The repair ring is connected to an amplifier circuit to compensate for a deterioration of the signal by the voltage drop. However, since the organic light emitting device is applied with a current driving method, a writing width of the data voltage is narrow, such that the voltage drop by the repair ring reacts very sensitively, and resultantly the repair of the faulty pixel is not completed.

In contrast, according to the present disclosure, after forming a repair ring at a peripheral portion and short-circuiting a faulty data line and the repair ring, a same data signal as the data signal transmitted to the faulty data line through the driving circuit is transmitted to the faulty data line through the repair ring, thereby driving the faulty data line without a voltage drop. Further, by forming a dummy connection wire intersecting the driving circuit output lines and short-circuiting the dummy driving pad connected to the repair ring and the driving pad connected to the faulty data line by using the laser, a same data signal as the data signal transmitted to the faulty data line is transmitted to the faulty data line through the repair ring, thereby driving the faulty data line without the voltage drop.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting device, comprising:

a substrate including a display unit to display an image and a peripheral portion surrounding the display unit;

a plurality of scan lines on the substrate and extending in a first direction;

a plurality of data lines on the substrate, the plurality of data lines intersecting the scan lines and extending in a second direction;

a plurality of pixels at the display unit, the plurality of pixels being connected to the scan lines and the data lines;

a repair ring on the peripheral portion of the substrate, the repair ring surrounding the display unit;

a plurality of driving pads on the peripheral portion of the substrate, the plurality of driving pads being connected to ends of the plurality of data lines;

a pair of dummy driving pads on the peripheral portion of the substrate, the pair of dummy pads being connected to ends of the repair ring;

a driving circuit to transmit a data signal to the plurality of driving pads and to the pair of dummy driving pads;

a plurality of driving circuit output lines connecting the driving circuit to each of the plurality of driving pads and each of the pair of dummy driving pads, the plurality of driving circuit output lines being positioned only in a region between the driving circuit and the driving pads and a region between the driving circuit and the dummy driving pads; and a dummy connection wire crossing the driving circuit output lines, the dummy connection wire being positioned between the dummy driving pads.

2. The organic light emitting device as claimed in claim 1, further comprising an amplifier positioned at each of the driving circuit output lines.

3. The organic light emitting device as claimed in claim 2, wherein the repair ring includes a left repair ring and a right repair ring.

4. The organic light emitting device as claimed in claim 1, wherein the dummy connection wire connects to each pair of the dummy driving pads and is positioned between the driving circuit and the driving pads.

5. The organic light emitting device as claimed in claim 1, wherein each amplifier is between the driving circuit and a corresponding one of the driving pads and the dummy driving pads.

6. The organic light emitting device as claimed in claim 5, wherein the driving circuit transmits the data signal directly to the plurality of driving pads and to the pair of dummy driving pads via corresponding amplifiers.

7. The organic light emitting device as claimed in claim 1, wherein the plurality of driving circuit output lines connects the driving circuit to each of the plurality of driving pads and each of the pair of dummy driving pads regardless of an existence of a failure of the data line.

8. The organic light emitting device as claimed in claim 1, wherein each of the pair of dummy driving pads is constantly and continuously connected to the driving circuit through corresponding driving circuit output lines.

9. The organic light emitting device as claimed in claim 1, wherein lengths of driving circuit output lines connected to the driving pads are equal to lengths of driving circuit output lines connected to the dummy driving pads.

10. A repairing method of an organic light emitting device, the method comprising:

detecting a failure of a data line of the organic light emitting device, the organic light emitting device including:

a substrate including a display unit to display an image and a peripheral portion surrounding the display unit, a plurality of scan lines on the substrate and extending in a first direction, a plurality of data lines on the substrate, the plurality of data lines intersecting the scan lines and extending in a second direction, a plurality of pixels at the display unit and connected to the scan lines and the data lines, a repair ring on the peripheral portion of the substrate, the repair ring surrounding the display unit, a plurality of driving pads on the peripheral portion of the substrate, the plurality of driving pads being connected to ends of the plurality of data lines, a pair of dummy driving pads on the peripheral portion of the substrate, the pair of dummy pads being connected to ends of the repair ring, a driving circuit to transmit a data signal to the plurality of driving pads and to the pair of dummy driving pads, and a plurality of driving circuit output lines connecting the driving circuit to each of the plurality of driving pads and each of the pair of dummy driving pads, the plurality of driving circuit output lines being positioned only in a region between the driving circuit and the driving pads and a region between the driving circuit and the dummy driving pads; and short-circuiting the repair ring with the detected failed data line, wherein short-circuiting the detected failed data line includes short circuiting the detected failed data line only at one point.

11. The repairing method as claimed in claim 10, further comprising transmitting a same data signal to a driving pad connected to the detected failed data line and to the dummy driving pad connected to the repair ring by using the driving circuit.

12. The repairing method as claimed in claim 10, further comprising forming an amplifier at each of the driving circuit output lines.

13. The repairing method as claimed in claim 12, further comprising:

short-circuiting the driving circuit output line connected to the driving pad connected to the detected failed data line and the dummy connection wire to each other; and transmitting the same data signal as the data signal transmitted to the driving pad connected to the detected failed data line to the dummy driving pad connected to the repair ring by using the shorted dummy connection wire.

* * * * *